US006631570B1

(12) United States Patent
Walker

(10) Patent No.: US 6,631,570 B1
(45) Date of Patent: Oct. 14, 2003

(54) ROTATIONALLY DETACHABLE LOW TO HIGH HEEL SHOES

(76) Inventor: Lisa Walker, 4607 Frontier, Houston, TX (US) 77041

( * ) Notice: Subject to any disclaimer, the term of this patent is extended or adjusted under 35 U.S.C. 154(b) by 0 days.

(21) Appl. No.: 10/077,697

(22) Filed: Feb. 7, 2002

(51) Int. Cl.[7] ..... A43B 21/36
(52) U.S. Cl. ..... 36/100; 36/42
(58) Field of Search ..... 36/100, 36 R, 36/41, 42, 15, 76 R

(56) References Cited

U.S. PATENT DOCUMENTS 2,656,621 A * 10/1953 Hoffmann ..... 36/42
2,937,461 A * 5/1960 Trela ..... 36/36 R
4,219,946 A * 9/1980 Baum ..... 36/42
4,272,897 A * 6/1981 Ponce ..... 36/24.5
4,363,177 A * 12/1982 Boros ..... 36/101
4,400,893 A 8/1983 Musei
5,477,625 A 12/1995 Goldsmith
5,581,910 A * 12/1996 Lewis ..... 36/36 R
6,442,871 B2 * 9/2002 Doerer et al. ..... 36/35 R

FOREIGN PATENT DOCUMENTS

GB 2276805 * 10/1984

* cited by examiner

*Primary Examiner*—M. D. Patterson

(57) ABSTRACT

A structure of a low to high heel shoe wherein a sole FIG. 1 having two semicircular "D" shaped punched holes on either side of the shank is formed in the rear of the shoe sole area, to receive a bolt fitting FIG. 2 having a bight slot and two opposing distal members, fitting through the punched holes and over the shoe shank thereby adjoining to the heel FIG. 4.

6 Claims, 1 Drawing Sheet

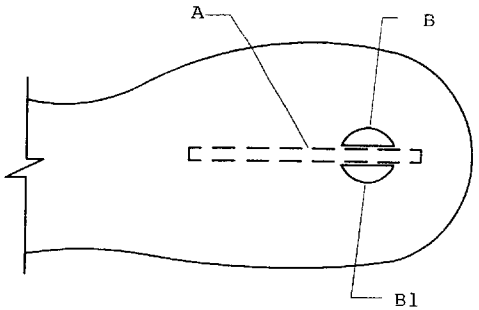
FIG. 1
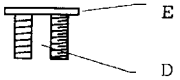
FIG. 2
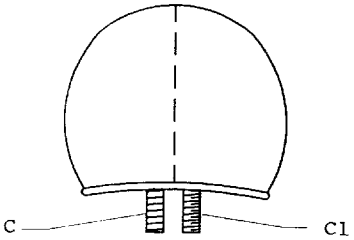
FIG. 3
FIG. 4
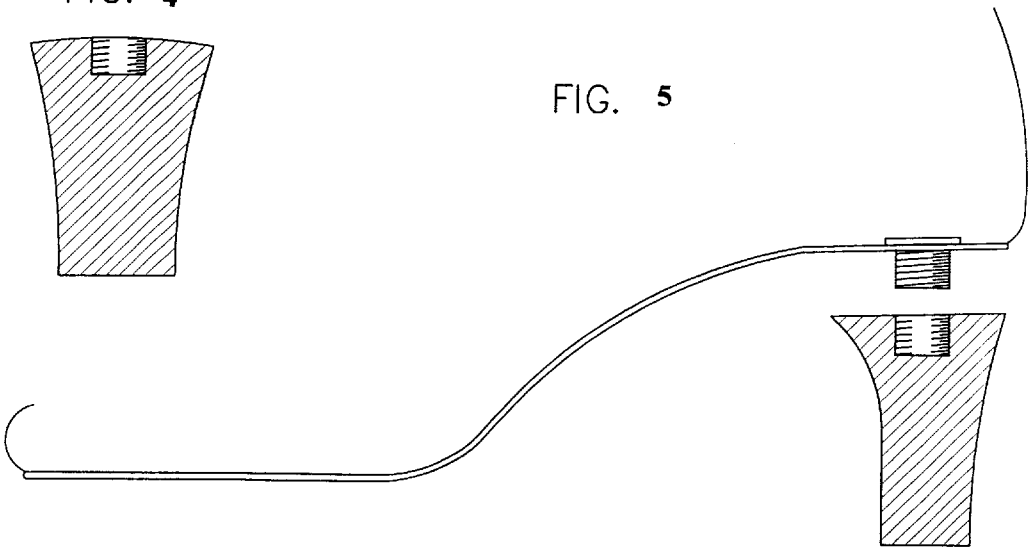
FIG. 5
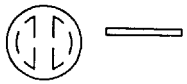
FIG. 6

ROTATIONALLY DETACHABLE LOW TO HIGH HEEL SHOES

CROSS REFERENCE

U.S. Pat. No. 4,363,177 to Boros 1982

U.S. Pat. No. 4,219,946 to Baum 1980

U.S. Pat. No. 4,400,893 to Musci 1983

U.S. Pat. No. 5,477,625 to Goldsmith et al 1995

STATEMENT REGARDING FEDERALLY SPONSORED RESEARCH OR DEVELOPMENT

Not Applicable

REFERENCE TO MICROFICHE

Not Applicable

FIELD OF INVENTION

The Rotationally Detachable low to high heel shoes facilitates a means to create individual style, regarding footwear, using a mode that is interchangeable and detachable. Providing a necessary means for change by the consumer in its unyielding desire to create individual style of shoes or boots in relation to clothing.

BACKGROUND OR RELATED ART

The following listed prior art has come to the attention of applicant. The prior art is believed relevant to, but patentably distinguishable from, the present invention and is being cited pursuant to Rule 91. A copy of each prior art publication is enclosed and its relevance is discussed below.

U.S. Pat. No. 4,219,946 Shoe w/ an interchangeable heel, Uwe Baum, Sep. 2, 1980

U.S. Pat. No. 4,363,177 Style convertible footwear, Leslie Boros, Dec. 14, 1982

U.S. Pat. No. 4,400,893 Shoe w/ removably mounted heel, Nicola Musei, Aug. 30, 1983

U.S. Pat. No. 5,477,625 Interchangeable shoe, Michael Goldsmith, Dec. 26, 1995

Baum creates his design with a rigid plate in the sole of the heel. This could potentially come away from the shoe because of the dissimilar materials, one of rigidity and one of flexibility. Also, much work and excess manufacture would constitute this design, leaving the cost of the product exorbitant. My invention solves this problem due to the use of conventional materials in making the shoe, there are no pieces, which could come away from the shoe, and the easy motion of rotating the heel on and off serves the consumer with a very low change over time.

Boros creates a similar design to that of Baum having the added cutout and insertion of a square like notch and indention mounted to the heel and shoe respectively. There is a notch like protrusion, which could break off during normal wear. This leaves the design unfavorable. The addition of an extra pin like feature leaves the design unsightly with multiple parts to keep inventory of. And also creates a time consuming style changeover. My invention uses no protrusions, which could break off during normal, wear and have no extra pieces which could become lost, and the easy motion of rotating the heel on and off serves the consumer with a very low change-over time.

Musei uses a small, slim screw that one must insert down through the sole and into the heel with an additional tool.

This design is also flawed due to the small screw, which will split from the heel because of direct pressure by wearer, during normal wear. The design is mostly time consuming for consumer. In addition, he uses a simi-rigid plastic sole that is unmanageable for lowering the heel. My invention uses a very thick bolt-fitting that could not potentially break, there are no tools needed to change heels, and the easy motion of rotating the heel on and off serves the consumer with a very low change-over time.

Goldsmith created a design totally unstable and unsightly. This design uses rubber which is extremely flexible lending no support to the wearer. An added inconvenience is the nuisance of a strap that purportedly secures the heel. This strap is objectionable due to the apparent volatility of movement from normal wear. The snap provides easy disengagement of the wearer from the shoe during normal wear. My invention solves these problems by creating a conventional looking shoe using the conventional shoemaking materials, already in use, and the easy motion of rotating the heel on and off serves the consumer with a very low changeover time.

BRIEF SUMMARY

Objectively, one can see the composition of the present invention will use a simple rotational means of disengagement from the heel, provided by a bolt-fitting with a bight slot forming two opposing distal ends, where such bolt is permanently bonded to the shoe sole through the necessary "D" shaped punched holes in the sole area. The shoe heel will be manufactured by injection mold process to constructively form the tapped female threads that correspond to the bolt fitting's threaded distal ends. Furthermore, a complete connected shoe, reminiscent of conventional design will be visualized by the public, having no visible structures that comprise the shoe form. Such an invention will transform the shoe and boot industry making the former way of manufacturing obsolete because the consumer will want the changes of style that only this invention can create. An offering of this invention will bring happiness to the consumer, due to the ever-changing clothing trends, which needs shoes that will fulfill interchangeable styles.

VIEWS OF DRAWINGS

FIG. 1 shows a top view looking downward upon the rear heel area in the sole of the shoe where "D" shaped holes are punched on each side of the shank juxtaposed to one another.

FIG. 2 shows a side view of a bolt-fitting shaped similar to a U-bolt, used to connect a heel to a shoe.

FIG. 3 shows the back view of a shoe where FIG. 2 is inserted into position.

FIG. 4 shows an injection molded heel with female threading to accept FIG. 2.

FIG. 5 shows a side view of the shoe heel area and heel before connection.

FIG. 6 shows a top view of flat, thin horizontal round head of bolt fitting,—FIG. 2.

NUMBER REFERENCE

A Shank

B Punched holes

C Distal ends of the bolt fitting

D Bight Slot

E Flat, Thin horizontally round head

DETAILED DESCRIPTION OF THE INVENTION

Referring to the drawings for a skilled artisan to manufacture and give a layperson a definitive narrative, FIG. 1 shows a view of the shoe sole area and punched "D" shaped holes B and B1 near the back of the shoe where the heel of the wearer will rest. FIG. 3 and FIG. 4 shows a view of the back of a completely constructed rotationally-detachable low to high heel shoe with the bolt fitting 2 bonded to the shoe sole FIG. 1, and a view of the injection molded shoe heel which will adjoin with the bolt fitting 2 by a simple rotation, connecting the two.

The shoe sole FIG. 1 is made of conventional materials; preferably leather. By reference, the shoe sole comprises two "D" shaped punched B and B1 in juxtaposition forming a backward "D" shape and a forward "D" shape at either side of the shoe's shank A, nearing the back of the sole area. It is possible for the punched holes to be rounded or squared, however for the aesthetic appeal of a finished product the "D" shape is preferred due to its corresponding shape to the bolt fitting's opposing distal ends C and C1.

To form a complete shoe sole FIG. 3 a male threaded bolt-fitting FIG. 2 must pass through the two "D" shaped punched holes B and B1. A bolt fitting in FIG. 2 shows a bight slot D and two opposing distal ends C and C1. Bolt fitting FIG. 2 is straddled over the shank A and through the two "D" shaped punched holes Ba nd B1 which is permanently bonded using glue or other fastening options. It is preferable for the bolt-fitting FIG. 2 to be manufactured of rigid plastic or polymer.

The embodiment of a complete shoe sole FIG. 3 with the shoe heel FIG. 4, includes an injection molded shoe heel having female threads to accept the bolt-fitting FIG. 2 and its two opposing distal ends C and C1. The shoe heel FIG. 4 will be tapped having female threading with a downward circular fashion or countersunk depression so that the bolt fitting FIG. 2 and its opposing distal ends C and C1 are oriented inside the shoe heel joining thereto. Preferably, this treading will remain at a static measurement after the injection mold has been obtained. Finding the longitudinal axis extending through the sole where the "D" shaped holes B and B1 will remain static allowing the connection of bolt fitting FIG. 2 and shoe heel FIG. 4. One skilled in mathematics or engineering will be able to obtain such measurement without difficulty.

FIG. 6 shows a top and side view of the thin flat horizontally rounded head of the bolt-fitting FIG. 2, which will cover a generous area of the shoe sole FIG. 1, after the bolt fitting FIG. 2 is permanently affixed to shoe sole FIG. 1. The rounded head FIG. 6 is preferred as opposed to squared or other geometric shape. By rotating the shoe heel FIG. 6 clockwise onto the bolt fitting FIG. 2 until rotation is stopped, a complete shoe is ready for wear. Conversely, by rotating the shoe heel FIG. 4 counter clockwise until the shoe heel is disjoined from the shoe sole FIG. 3 and exposing the bolt fitting FIG. 2 will provide the wearer with a new option for joining a second differently styled shoe heel FIG. 4.

FIGS. 2—bolt fitting and 4—heel, may be formed of a rigid plastic or similar material.

It is understood that for adjoining and disjoining, only the heel needs rotation.

I claim:

1. A low to high heel shoe or boot with a composition of:

a shoe sole having in a heel portion a backward "D" shape and forward "D" shape punched hole, said punched holes having juxtaposition on either side of shank near a heel portion of said shoe sole, a bolt fitting permanently bonded to said shoe sole, said bolt fitting having a bight and two threaded opposing distal ends, said opposing distal ends passing through and straddling said "D" shaped punched holes of said shoe sole, a rotationally-detachable shoe heel, said shoe heel having downwardly driven threads.

2. A shoe or boot of composition in claim 1, wherein said bolt fitting has a generally flat horizontally rounded head covering a generous portion of said shoe sole.

3. A shoe or boot of composition in claim 1, in which said "D" shaped punched holes corresponds to the periphery measurement of said opposing distal ends of said bolt fitting so as to allow passage of said opposing distal ends.

4. A shoe or boot of composition in claim 1, wherein said threads are generally atop said shoe heel, extending in a downward circular fashion making a cavity such that receives said opposing distal ends of said bolt fitting.

5. A shoe or boot of composition in claim 1, in which the circumference of said bolt fitting distal ends measure smaller to said threads of said shoe heel.

6. A shoe or boot of composition in claim 1, in which said shoe heel is injection molded.

* * * * *